United States Patent [19]

Staats

[11] 4,341,937

[45] Jul. 27, 1982

[54] MICROWAVE OVEN COOKING PROGRESS INDICATOR

[75] Inventor: James E. Staats, Louisville, Ky.

[73] Assignee: General Electric Company, Louisville, Ky.

[21] Appl. No.: 211,019

[22] Filed: Nov. 28, 1980

[51] Int. Cl.[3] ..... H05B 6/28

[52] U.S. Cl. ..... 219/10.55 M; 219/10.55 R; 219/10.55 B

[58] Field of Search ..... 219/10.55 F, 10.55 B, 219/10.55 M, 10.55 R, 10.55 A, 10.55 D

[56] References Cited

U.S. PATENT DOCUMENTS

| | | | |
|---|---|---|---|
| 2,744,990 | 5/1956 | Schroeder | 219/10.55 |
| 3,104,304 | 9/1963 | Sawada | 219/10.55 |
| 3,281,567 | 10/1966 | Meissner et al. | 219/10.55 |
| 3,321,604 | 5/1967 | Stecca et al. | 219/10.55 |
| 3,412,227 | 11/1968 | Anderson | 219/10.55 |
| 3,467,804 | 9/1969 | Smith | 219/10.55 |
| 3,491,222 | 1/1970 | Kohler et al. | 219/10.55 |
| 3,527,915 | 9/1970 | Haagensen et al. | 219/10.55 |
| 3,662,140 | 5/1972 | Jones et al. | 219/10.55 |
| 3,670,134 | 6/1972 | Bucksbaum | 219/10.55 |
| 3,813,918 | 6/1974 | Moe | 219/10.55 |
| 3,854,022 | 12/1974 | Moore | 219/10.55 |
| 3,875,361 | 4/1975 | Fukui et al. | 219/10.55 |
| 3,936,626 | 2/1976 | Moore | 219/10.55 |
| 3,975,720 | 8/1976 | Chen et al. | 219/10.55 |
| 3,999,027 | 12/1976 | Moore | 219/10.55 |
| 4,009,359 | 2/1977 | Tallmadge et al. | 219/10.55 |
| 4,035,599 | 7/1977 | Kashyap et al. | 219/10.55 |
| 4,041,266 | 8/1977 | Moore | 219/10.55 |
| 4,049,938 | 9/1977 | Ueno | 219/10.55 |
| 4,086,813 | 5/1978 | Meek et al. | 219/10.55 |

*Primary Examiner*—Arthur T. Grimley

*Attorney, Agent, or Firm*—H. Neil Houser; Radford M. Reams

[57] ABSTRACT

Apparatus and methods for determining the progress of a food load cooked within a microwave oven responsive to changes in dielectric or electrical load characteristics of the food load as it is heated. A particularly sensitive indication is provided by placing the food load between a microwave feed point and an RF voltage probe.

6 Claims, 9 Drawing Figures

MICROWAVE OVEN COOKING PROGRESS INDICATOR

BACKGROUND OF THE INVENTION

The present invention relates generally to apparatus and methods for the purpose of determining the progress of a food load being cooked or otherwise heated in a microwave oven. More particularly, the invention relates to such apparatus and methods responsive to changes in electrical characteristics of the food load as it is heated, particularly changes as a result of variations in state and quantity of moisture content.

It is desirable in a cooking microwave oven to be able to monitor or determine the progress of food being cooked or heated. While microwave ovens typically include viewing windows, such windows provide limited visibility, and often little information is obtained concerning the progress of food cooking by observing the appearance in any event. One general method, useful particularly in the case of large pieces of meat being cooked, is to employ a temperature-sensing probe assembly inserted into the food being cooked, such as is disclosed in the Chen et al. U.S. Pat. No. 3,975,720 and in the Meek et al. U.S. Pat. No. 4,086,813. However, the use of such a probe is not always convenient or possible, and it desirable to provide further alternative approaches. (As employed herein, the term "cooking" is employed in a broad sense to mean the heating or thermalization of food placed in a microwave oven, regardless of the particular temperature range over which the heating occurs and regardless of the particular chemical or physical change occurring within the food.)

Another general method of providing information about the progress of food cooking in a microwave oven relies upon changes in the characteristics of the food as an electrical load or a microwave absorber during cooking. For example, conductivity and dielectric properties of food change during cooking or heating, particularly as water content is affected by the microwave heating. One known approach relying upon such changes monitors the standing wave ratio or a related property within a feed waveguide or other form of transmission line supplying the microwave cooking cavity. This general approach is disclosed for example in the Moe U.S. Pat. No. 3,813,918.

Although not directly responsive to changes in the load properties of individual items of food as cooking progresses, similar sensing principles have been proposed for controlling the length of cooking time as a function of energy delivered to a food load or available energy apportioned between a plurality of individual items of food. For example, in the system of the Schroeder U.S. Pat. No. 2,744,990, cooking time is related to net energy supplied to the microwave cooking cavity as determined by a directional coupler in a feed transmission line, net power delivered being sensed forward power minus sensed reflected power. Similarly, in the systems described in the Moore U.S. Pat. No. 3,999,027 and Tallmadge et al. U.S. Pat. No. 4,009,359, microwave field strength is sensed within the cooking cavity itself, rather than in a feed waveguide, for the purpose of controlling the time duration of operation to achieve a desired temperature within a food load material. With a higher microwave field strength, it is assumed that the cooking effect is greater, and the time duration is accordingly shortened. Specifically, electromagnetic field strength is integrated with respect to time as an indicator of overall cooking effect.

Another condition which may be sensed using related techniques, particularly for protective purposes, is the absence of any food load whatsoever within the microwave cooking cavity. Under such conditions, the standing wave ratio within the feed waveguide, as well as the field strength within the cavity, are higher than normal. Various systems have been proposed for sensing such conditions, and automatically turning off the microwave generator in response. For example, the system of the Meissner et al. U.S. Pat. No. 3,281,567 directly senses field strength within a cooking cavity. In a somewhat similar fashion, the system of the Haagensen et al. U.S. Pat. No. 3,527,915 indirectly responds to field strength within a cooking cavity by sensing the temperature rise of an element placed at the bottom of the cavity and which absorbs microwave energy. Other protective systems respond to conditions within the feed waveguide, for example, as disclosed in the Anderson U.S. Pat. No. 4,412,227, the Kohler et al. U.S. Pat. No. 3,491,222, the Jones et al. U.S. Pat. No. 3,662,140, and the Bucksbaum U.S. Pat. No. 3,670,134.

In a somewhat different vein, a related principle of operation is utilized in an automatic control system for a continuously-moving type microwave dryer disclosed in the Kashyap et al. U.S. Pat. No. 4,035,599. In the Kashyap et al. system, microwave energy is passed through a moving web load, such as paper. Input power and output power are separately sensed by means of directional couplers. In order to control microwave input power to maintain a constant drying effect, microwave input power is varied as a function of sensed input and output power, as well as of web velocity.

The effect of varying quantities of food and changes within a food load as cooking progresses is recognized in the systems of the Sawada U.S. Pat. No. 3,104,304 and the Stecca et al. U.S. Pat. No. 3,321,604, each attempting to maintain optimum conditions as the food changes. In Sawada, the oscillator frequency is varied to maintain resonance. In Stecca et al., the cavity itself is tuned to maintain resonance.

Various non-electrical approaches to the problem of monitoring cooking progress in a microwave oven have also been proposed. For example, the Smith U.S. Pat. No. 3,467,804 proposes a sensor for steam or other vapors which may be emitted when an article of food is heated, or has reached a predetermined temperature. In the Ueno U.S. Pat. No. 4,049,938, an infrared radiation detector is proposed.

While the various approaches described above for indirectly obtaining information concerning the progress of food being cooked in a microwave oven, particularly those which rely upon a change in the load properties of the food itself, do function to some extent, greater sensitivity is desirable. This greater sensitivity is provided by the apparatus and method of the present invention. In particular, the sensing effected by the present invention provides a relatively large percentage change in the sensed parameter depending upon the dielectric properties of the food load, particularly as a result of the state and quantity of its moisture content.

SUMMARY OF THE INVENTION

Accordingly, it is an object of the invention to provide apparatus and methods for providing information concerning the progress of cooking or heating in a microwave oven.

It is another object of the invention to provide such apparatus and methods which provides a highly sensitive measurement.

It is still another object of the invention to provide such apparatus and methods of the general type which rely upon changes in the load characteristics of the food being cooked, for example dielectric loss properties and conductivity.

Briefly stated, and in accordance with one aspect of the invention, a cooking microwave oven includes a cooking cavity bounded by conductive walls, and a support such as a horizontal dielectric shelf for supporting a food load at an intermediate region within the cavity. A feed point, for example, a probe antenna having a rear reflector, is located along one wall of the cavity, preferably the top wall, for introducing microwave energy into the cavity in a direction generally away from the top wall and toward the intermediate region where the food load is supported. An electromagnetic field strength sensor, for example an RF voltage probe connected to a rectified diode, is located along a wall of the cooking cavity opposite the feed point, preferably the bottom wall, such that the intermediate region where the food load is supported is interposed between the feed point and the field strength sensor. Significantly, as a result of this particular arrangement of elements, sensed electromagnetic field strength provides an unusually sensitive measure of the amount of microwave energy not absorbed by the food load, but which rather flows around and through the food load.

In operation, the sensed electromagnetic field strength provides a sensitive indication of conditions within the food being cooked, particularly as to moisture content. As is known, high liquid water content in food results in relatively high microwave absorption characteristics. As water is driven out, the microwave absorption decreases. In the arrangement of the present invention, a significant change in microwave field strength results.

It is also known, that water in solid form, i.e., ice, absorbs a very little microwave energy. As frozen food is thawed by microwave energy and water content changes state from solid to liquid form, the amount of energy absorbed by the food increases. The sensing arrangement of the present invention provides a sensitive indication of the progress of the thawing process.

Briefly stated, and in accordance with another aspect of the present invention, a method for monitoring the progress of cooking in a microwave oven comprises the steps of supporting a food load at an intermediate region within a microwave cooking cavity, introducing cooking microwave energy from a feed point into the cavity in a direction generally toward the food load, and sensing electromagnetic field strength within the cavity at a location separated from the feed point by the load.

While the present invention is primarily envisioned as a cooking progress monitor, the system inherently provides the means to sense the absence of any load in the cooking cavity, and advantageously may be employed for this purpose as well.

BRIEF DESCRIPTION OF THE DRAWINGS

While the novel features of the invention are set forth with particularity in the appended claims, the invention, both as to organization and content, will be better understood and appreciated from the following detailed description taken in conjunction with the drawings in which:

DETAILED DESCRIPTION OF THE PREFERRED EMBODIMENTS

Figure 1:
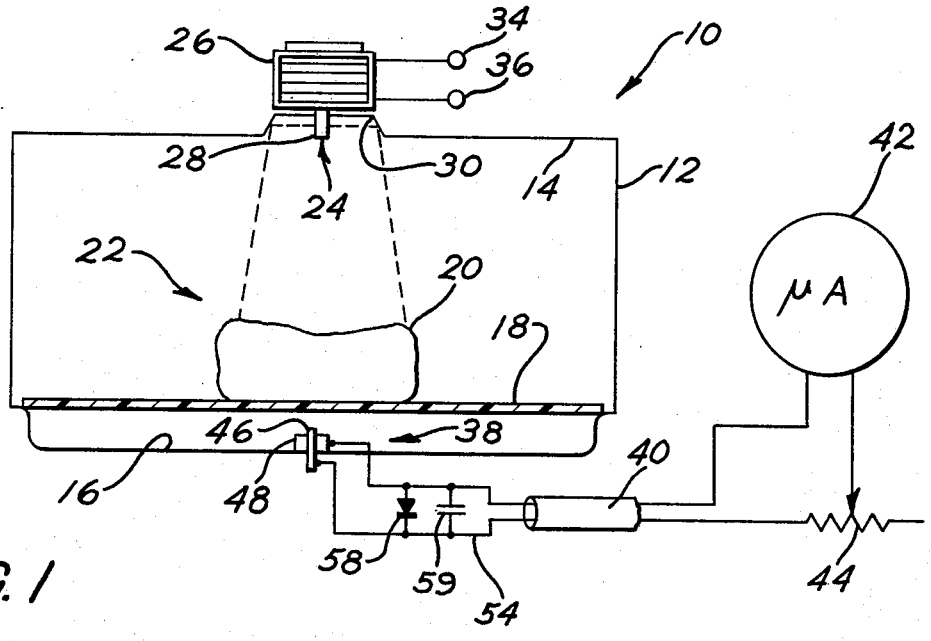
FIG. 1 is a highly schematic front elevational view of a microwave oven cooking cavity embodying the present invention.

Referring first to FIG. 1, a microwave oven, generally designated 10, includes a cooking cavity 12 bounded by conductive walls including a top wall 14 and a bottom wall 16, with a horizontal dielectric shelf 18 for supporting a food load 20 at an intermediate region 22 within the cavity 12. A feed point, generally designated 24, is located along one wall of the cavity 12, preferably the top wall 14, for introducing microwave energy into the cavity 12 in a direction away from the top wall 14 and toward the intermediate region 22 where the food load 20 is supported. More particularly, the feed point 24 comprises a conventional magnetron 26 providing 2450 MHz microwave energy at a probe antenna 28 backed by a rear reflector 30 of frustoconical or pyramidal configuration for directing energy generally toward the intermediate region 22 as indicated by the dash lines 32.

The magnetron 26 is a conventional device which, it will be appreciated, self-generates microwave energy when supplied at its electrical input terminals 34 and 36 with a suitable DC voltage. It will further be appreciated that a suitable high voltage magnetron power supply, as well as various conventional control components, are required for the microwave oven 10, these being entirely conventional and omitted for clarity of illustration.

Located along a wall of the cavity, preferably the bottom wall 16, opposite the feed point 24 is an electromagnetic field strength sensor, generally designated 38. More particularly, the electromagnetic field strength sensor 38 is located such that the food load 20 is supported within the cavity 12 in a position interposed between the feed point 24 and the field strength sensor 38.

The field strength sensor 38 is preferably an RF voltage sensor, and produces a DC voltage or current output connected through a conductor, shown as a coaxial cable 40, to a visual indicator in representative form as a microammeter 42, with a sensitivity-adjustment variable resistor 44 connected in series. The visual indicator may take various alternative forms, such as a series of progressively-energized or progressively-de-energized LED'S. Preferably, the microammeter 42 is provided with a reverse scale so that a m ximum reading, indicating maximum power absorbed by the food load 20, occurs when RF voltage measured by the sensor 38 is at a minimum.

In operation, electromagnetic field strength (RF voltage) as sensed by the sensor 38 and indicated on the meter 42 provides a sensitive measure of the amount of microwave energy not absorbed by the food load 20, but which rather flows around and through the food load. Significantly, the particular physical arrangement of the various components according to the present invention provides a high degree of sensitivity to the amount of microwave energy absorbed or not absorbed, as the case may be, by the food load 20, as is discussed more fully hereinafter with particular reference to FIGS. 5–9.

Figure 2:
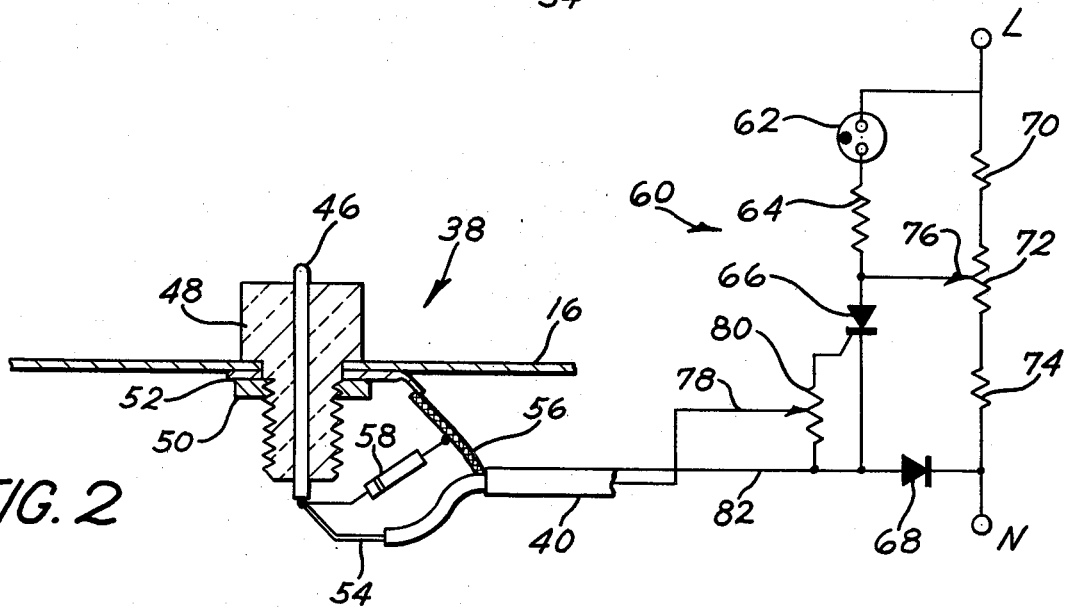
FIG. 2 is a greatly enlarged view of a portion of FIG. 1 showing the electromagnetic field strength probe portion thereof, together with an alternative circuit arrangement.

Referring in addition to FIG. 2, enlarged details of the electromagnetic field strength sensor 38 located on the bottom wall 16, are shown. An RF probe 46 protrudes up through the bottom wall 16 approximately $\frac{1}{4}$ inch into the cooking cavity 12, and is surrounded by a low-loss support element 48, depicted as a threaded ceramic element. The ceramic support element 48 is in turn secured to the bottom wall 16 by means of a threaded nut 50 bearing against a lug washer 52 provided for making electrical contact with the bottom wall 16.

The field strength sensor 38, and particularly the probe 46 thereof, is connected to an inner conductor 54 of the coaxial cable 40, with the coaxial cable 40 outer conductor or shield braid 56 connected to the lug washer 52. A suitable RF rectifier diode 58 is connected between the probe 46 and the lug washer 52, which also serves as a ground connection. A discrete RF bypass capacitor 59 is shown in FIG. 1; this particular element is omitted in FIG. 2 wherein the inherent capacitance of the coaxial cable 40 provides the RF bypass function at the 2450 MHz operating frequency.

In FIG. 1, the field strength sensor 38 is shown connected to a meter 42 for directly providing a visual indication of measured field strength. In FIG. 2, the field strength sensor 38 is alternatively connected to a threshold circuit 60, the function of which is to energize a neon lamp 62 when sensed field strength rises above a predetermined threshold, indicative of there being no load within the cooking cavity 12. While no load sensing is not the primary object of the invention, FIG. 2 is included to illustrate that the arrangement of the invention is useful for this purpose as well.

In particular, the FIG. 2 threshold circuit 60 operates from 120 volt, 60 Hz AC power applied between L and N terminals. The neon lamp 62 is connected between these L and N terminals in series with a current limiting resistor 64, an SCR switching device 66, and an isolation diode 68. A biasing network includes a resistor 70, a potentiometer 72 and another resistor 74 connected in series between the L and N terminals, with the potentiometer 72 wiper 76 connected to the junction of the current-limiting resistor 64 and the SCR 66 anode terminal.

For triggering the SCR 66, the center conductor 78 of the coaxial cable 40 is connected through an input-sensitivity adjustment potentiometer 80 to the SCR 66 gate terminal, while the coaxial cable 40 outer conductor 82 is connected to the SCR 66 cathode.

In the operation of the FIG. 2 arrangement, and particularly the threshold circuit 60 thereof, when sensed electromagnetic field strength is above a predetermined threshold indicative of there being no load within the cooking cavity 12, sufficient current is applied to the SCR 66 gate terminal, causing it to be triggered into conduction, completing and energizing circuit to the neon lamp 62.

Figure 3:
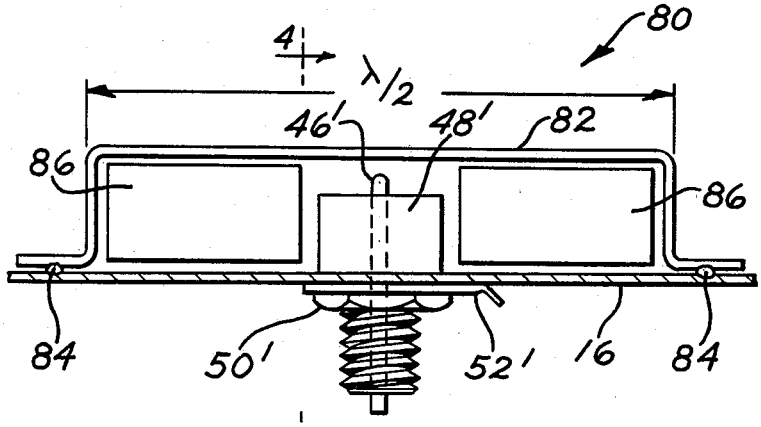
FIG. 3 is a view similar to FIG. 2 showing a probe for use where greater signal strength is desired.
Figure 4:
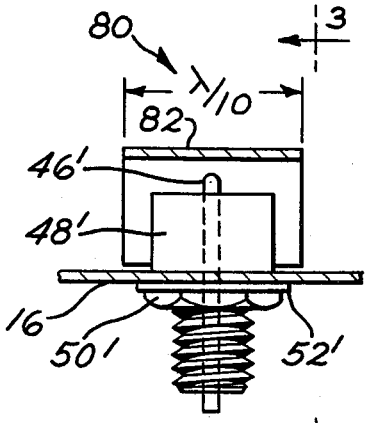
FIG. 4 is a view taken along line 4—4 of FIG. 3.

Referring now to FIGS. 3 and 4, an alternative form of electromagnetic field strength sensor 80 is shown for use where the FIG. 2 form provides insufficient signal strength. In FIGS. 3 and 4, the basic probe and support structure are identical to that which is depicted in FIG. 2, and these elements are accordingly designated by primed reference numerals corresponding to the reference numerals of FIG. 2. However, the field strength sensor 80 of FIGS. 3 and 4 additionally includes a half-wave resonator comprising a metal strap 82 or the like bent into a shallow-U configuration and positioned over the probe 46'. The resonator 82 is mechanically secured and electrically connected to the cooking cavity bottom wall 16 by means of welds 84. The resonator 82 has a height sufficient to clear the probe 46' and, as seen in FIG. 3, an electrical length of $\frac{1}{2}$ wavelength. As shown in FIG. 4, the width of the resonator 82 is approximately 1/10 wavelength.

In order to decrease the physical size of the resonator 82 to achieve the desired electrical size, namely $\frac{1}{2}$ wavelength, it preferably is loaded with a low-loss dielectric material 86.

The advantageous sensitivity of the apparatus and method of the present invention will be apparent from FIGS. 5, 6, 7, 8 and 9, as described next below.

Figure 5:
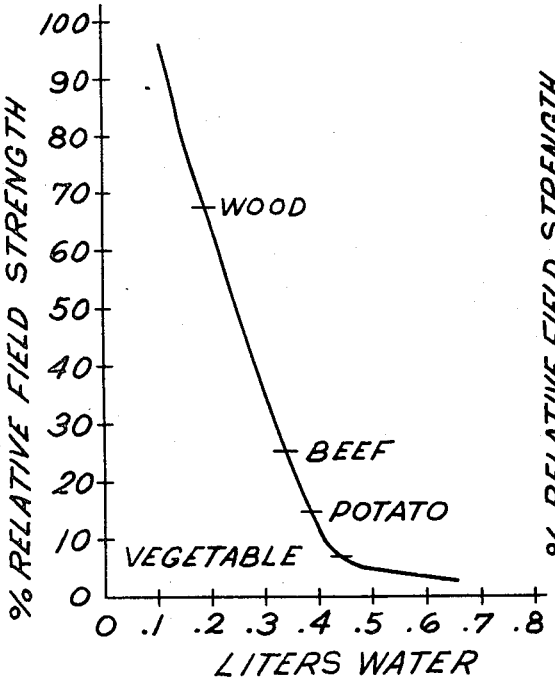
FIG. 5 is a plot depicting relative field strength as a function of liquid water content.

Preliminary, FIG. 5 is a graph of relative field strength as measured by the sensor 38 (FIGS. 1 and 2) or 80 (FIG. 3) as a function of water content in a food load being cooked. Significantly, the relative field strength varies through an extremely wide range, resulting in a high degree of sensitivity. As shown, for less than approximately 0.1 liters of water, the sensed field strength is nearly 100% of the no-load field strength. For water loads of 0.4 liters or more, the relative field strength drops to 10% or less, a 10:1 decrease, inherently providing extreme sensitivity.

Located along the FIG. 5 plot are tick marks denoting the relative moisture content of four items which may be placed in a microwave oven, specifically, wood, beef, potato and vegetable. It will be seen that these various materials and foods provide significantly different field strengths when measured at the particular position in accordance with the invention.

Figure 6:
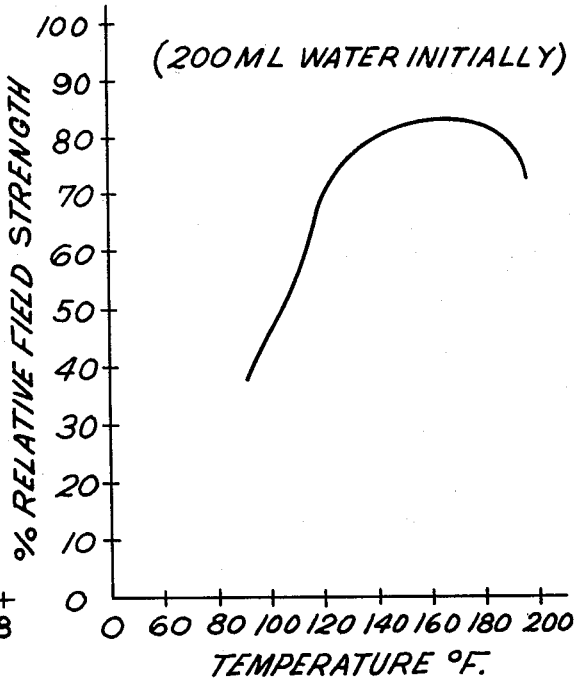
FIG. 6 is a plot of relative feed strength as a function of food temperature as moisture is driven out during microwave heating.

FIG. 6 shows a plot of relative field strength as a function of temperature (and time) as a food load is heated, and moisture is driven out. The load whose characteristics are depicted in FIG. 6 initially contains approximately 200 milliliters of water, and results in a relative field strength of approximately 40%. As microwave heating progresses, water is driven off and temperature increases. It will be seen that field strength significantly increases, reaching a level of approximately 80%, representing a 2:1 increase.

This substantial increase, is readily observed, such as for example on the FIG. 1 microammeter 42, and indicates that much less microwave energy is being absorbed by the particular food load.

Figure 7:
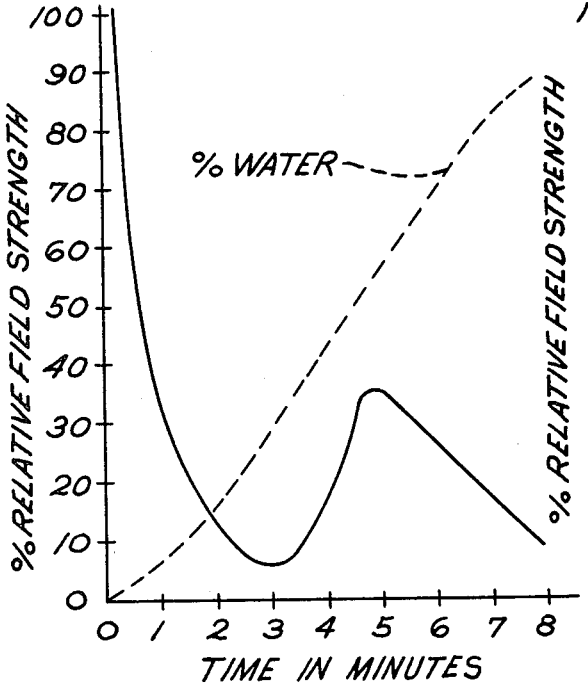
FIG. 7 is a plot of relative field strength as a function of time as a quantity of ice is melted.

The apparatus and method of the invention is also useful in determining the progress of thawing operations, during which ice (a poor microwave absorber)

changes to liquid water (a good microwave absorber). Specifically, FIG. 7 plots microwave field strength as a function of time as a solid block of ice is melted. Initially, measured relative field strength is nearly 100%, indicating very little energy is absorbed by the ice. However, as time progresses and the ice is converted to liquid form, the energy absorbed by the load increases, with a consequent substantial decrease in measured field strength. The dash line in FIG. 7 plots the percentage of water as a function of time.

Figure 8:
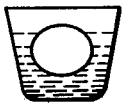
FIG. 8 is a view showing the configuration of a partially-melted quantity of ice the field strength characteristic of which is depicted in FIG. 7.

For reference purposes, FIG. 8 shows the shape of a partially-melted block of ice 86 such as was used to produce the plot shown in FIG. 7.

The hump in the FIG. 7 curve is believed to be the result of an interaction of the particular physical dimensions of the still-solid ice and the liquid water as the melting operation proceeds. Despite the slight aberration in the shape of the curve, it will be appreciated that the FIG. 7 curve provides a sensitive indication of melting progress.

Figure 9:
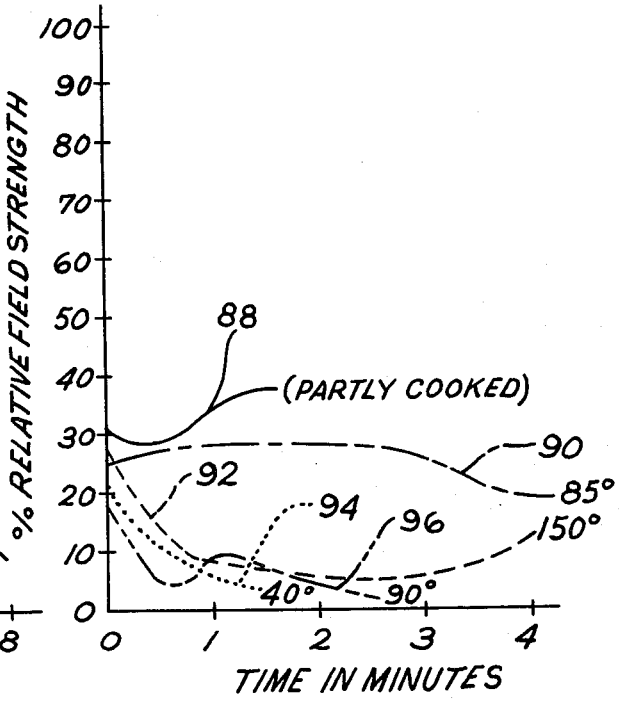
FIG. 9 shows several plots of relative field strength as a function of time for various foods which may be heated in a microwave oven.

The experimental curve of FIG. 7 from water alone is extended to actual food loads in FIG. 9. In FIG. 9, the solid line 88 represents the thawing of frozen hot dogs, the long-short dash line 90 represents the thawing of two pounds of frozen hamburger, the dash line 92 represents the thawing of a potato, the dot-dot line 94 represents the thawing of frozen lima beans, and the long-short-short line 96 represents the thawing of frozen peas. In each case, the temperature at the end of the particular process illustrated is also shown, with the exception of the line 88 for hot dogs, which, as indicated, were partly cooked.

From the various curves of FIG. 9, it may be seen there is a pronounced drop in relative field strength at a certain point in the thawing operation, indicative of a substantially complete conversion of the frozen moisture to liquid moisture with a consequent increase in microwave energy absorbed by the food load. In addition, several of the FIG. 9 curves show a later increase in relative field strength as the thawing phase finishes and actual cooking begins, and absorbed microwave energy descreases as a result of water loss.

In view of the foregoing, it will be appreciated that the present invention, as a result of the particular placement of a microwave field strength sensor within a cavity with respect to a microwave feed point and the positioning of a food load, provides a sensitive indicator of cooking progress, particularly with respect to the state of moisture content within the food.

While particular embodiments of the invention have been illustrated and described herein, it will be appreciated that numerous modifications and changes will occur to those skilled in the art. It is therefore to be understood that the appended claims are intended to cover all such modifications and changes as fall within the true spirit and scope of the invention.

What is claimed is:

1. In a microwave oven of the type having a cooking cavity bounded by conductive walls, and which employs electromagnetic field strength sensing within the cavity, the improvement comprising:

a support for supporting a food load at an intermediate region within the cavity;

a feed point along one wall of the cavity for introducing microwave energy into the cavity in a direction generally away from the one wall and toward said intermediate region where the food is supported within the cavity; and an electromagnetic field strength sensor located along a wall of the cavity opposite said feed point such that the intermediate region where the food load is supported within the cavity lies substantially directly between said feed point and said field strength sensor; whereby sensed electromagnetic field strength provides a sensitive measure of the amount of microwave energy not absorbed by the food load, but which rather flows around and through the food load.

2. The improvement according to claim 1, which further comprises a visual indicator connected to and responsive to said electromagnetic field strength sensor.

3. The improvement according to claim 1, wherein said feed point comprises a probe antenna having a rear reflector.

4. The improvement according to claim 1, wherein said electromagnetic field strength sensor comprises an RF probe connected to a rectifier diode and RF bypass coapacitor to produce a DC voltage dependent upon sensed field strength.

5. The improvement of claim 1 wherein said support comprises a dielectric shelf spaced from said wall opposite said feed point.

6. A method for monitoring the progress of cooking in a microwave oven of the type employing means to sense field strength in the cavity, said method comprising:

supporting a food load at an intermediate region within a microwave cooking cavity;

introducing cooking microwave energy from a feed point into the cavity in a direction generally toward the food load; and sensing electromagnetic field strength within the cavity at a location substantially in line with the food load and the feed point and separated from the feed point by the food load;

whereby sensed electromagnetic field strength provides a sensitive measure of the amount of microwave energy not absorbed by the food load, but which rather flows around and through the food load.

* * * * *